US009643038B1

(12) United States Patent
Chen

(10) Patent No.: US 9,643,038 B1
(45) Date of Patent: May 9, 2017

(54) CONCEALED FIRE SPRINKLING HEAD HAVING DECORATING FASTENED STRUCTURE

(71) Applicant: PROTECTOR SAFETY IND., LTD., Taoyuan County (TW)

(72) Inventor: Jung-Wen Chen, Taoyuan County (TW)

(73) Assignee: PROTECTOR SAFETY IND., LTD., Taoyuan County (TW)

( * ) Notice: Subject to any disclaimer, the term of this patent is extended or adjusted under 35 U.S.C. 154(b) by 0 days.

(21) Appl. No.: 15/065,163

(22) Filed: Mar. 9, 2016

(30) Foreign Application Priority Data

Dec. 2, 2015 (TW) ..... 104219322 U

(51) Int. Cl.

| | |
|---|---|
| ***A62C 37/08*** | (2006.01) |
| ***A62C 35/68*** | (2006.01) |
| ***B05B 15/00*** | (2006.01) |
| ***A62C 31/02*** | (2006.01) |
| ***A62C 37/12*** | (2006.01) |
| ***B05B 1/28*** | (2006.01) |

(52) U.S. Cl.
CPC ..... *A62C 35/68* (2013.01); *A62C 31/02* (2013.01); *A62C 37/12* (2013.01); *B05B 1/28* (2013.01); *B05B 15/001* (2013.01)

(58) Field of Classification Search
CPC ..... A62C 35/68; A62C 31/02; A62C 37/12; B05B 15/001; B05B 1/28
USPC ..... 169/37, 41, 42; 239/288–288.5
See application file for complete search history.

(56) References Cited

U.S. PATENT DOCUMENTS

| | | | | |
|---|---|---|---|---|
| 6,374,919 | B1 * | 4/2002 | Neill | A62C 37/09 169/37 |
| 8,381,825 | B1 * | 2/2013 | Golinveaux | A62C 37/08 169/37 |
| 8,776,903 | B2 * | 7/2014 | Jimenez | A62C 37/12 169/37 |
| 8,960,319 | B2 * | 2/2015 | Orr | A62C 37/09 169/41 |

* cited by examiner

*Primary Examiner* — Steven J Ganey
(74) *Attorney, Agent, or Firm* — Chun-Ming Shih

(57) ABSTRACT

A concealed fire sprinkling head having a decorating fastened structure comprising a sprinkling head at both sides of which a rib is formed, and a fastening slot being respectively formed at an outer wall of the rib; a sheet-like fastening piece at a center of which a passing hole for extending and passing through the sprinkling head, a guiding groove being symmetrically formed at an inner side of the passing hole, a clip hook being formed in the guiding groove, the rib being guided by the guiding groove for fastening in the fastening slot by the clip hook, and at least two tongue strip-like legs being formed at a periphery of the fastening piece; and a cup-like decorating cover adhered to a bottom of the fastening piece via the legs. Thus, a problem saying a structure of the fastening piece is too complex is solved.

5 Claims, 3 Drawing Sheets

CONCEALED FIRE SPRINKLING HEAD HAVING DECORATING FASTENED STRUCTURE

BACKGROUND OF THE INVENTION

1. Field of the Invention

The present invention relates to a structural technique of a concealed fire sprinkling head, particularly to a concealed fire sprinkling head having a decorating fastened structure.

2. Description of Related Art

The conventional general fire sprinkling heads are substantially divided into concealed-type, semi-concealed-type and open-type fire sprinkling heads. For the concealed-type fire sprinkling heads, the sprinkling head and its connected pipes are concealed in the ceiling in order to show a decorating mask.

For example, Taiwanese Patent Publication No. M475971 disclosed a holding device for fastening a decorating mask of a fire sprinkling head. A confining portion is respectively formed by ribs at both sides of a valve seat. A guiding portion and a fastening portion are respectively symmetrically formed at both ends of the decorating mask. The fastening portion is engaged and fastened to the confining portion by guiding of the guiding portion for the decorating mask, while the guiding portion is more combined with the valve seat for increasing stability and firmness by means of confining the guiding portion through the rib.

The decorating mask comprises a fastening component and a decorating cover. The decorating mask is mounted on the sprinkling head via the fastening component. The decorating cover is adhered to a bottom of the fastening component for hiding and covering the sprinkling head by the decorating cover so as to preventing the sprinkling head directly exposing on a ceiling.

Moreover, the guiding portion, the confining portion and a binding portion for adhering the decorating cover are formed on the fastening component. A cavity for receiving the sprinkling head is formed in the fastening component. Thus, the structure of the fastening component is too complex to decrease difficulty of process of manufacturing the fastening component. How to simplify the structure of the fastening component will be a technology subject to be studied and overcomed.

SUMMARY OF THE INVENTION

The objective of the present invention is to solve the problem of much complexity of the structure of the fastening component by providing a concealed fire sprinkling head having a decorating fastened structure.

In order to achieve the objective, the technical plan of this invention is to provide a concealed fire sprinkling head having a decorating fastened structure comprising:

a sprinkling head at both sides of which a rib is formed, and a fastening slot being respectively formed at an outer wall of the rib;

a sheet-like fastening piece at a center of which a passing hole for extending and passing through the sprinkling head, a guiding groove being symmetrically formed at an inner side of the passing hole, a clip hook being formed in the guiding groove, the rib being guided by the guiding groove for fastening in the fastening slot by the clip hook, and at least two tongue strip-like legs being formed at a periphery of the fastening piece; and a cup-like decorating cover adhered to a bottom of the fastening piece via the legs, a cavity being formed in the decorating cover for receiving the sprinkling head.

In one preferred embodiment of the present invention, a ventilating hole for fluidly connecting to the cavity is preferably formed on a surface of the decorating cover.

According to the present invention, an ear portion preferably extends and is formed at two ends of the fastening piece, and the legs are respectively formed at a bottom of the ear portion.

According to the present invention, a receiving groove is preferably formed between the ear portions and the legs, an elastic component is disposed in the receiving groove and two ends of the elastic component respectively contact the ear portions and the decorating cover.

According to the present invention, the elastic component is a spring having a U-shape.

According to the above techniques of this invention, after comparison with the well-know techniques the advantages of the present invention are that the cavity for receiving the sprinkling head is formed on the decorating cover having a simple structure and formed by easy punching so as to exhibit a cup-shaped body for beautifying the ceiling. Thus, the fastening piece is designed to be a sheet-shaped body in order to simplify the structure of the fastening piece having the guiding grooves, the clip hooks and the legs for converting into a one-piece body formed by punching a sheet-shaped body extending. The complexity of the structure of the fastening piece is decreased so as to decrease total cost of producing the concealed fire sprinkling head having a decorating fastened structure.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
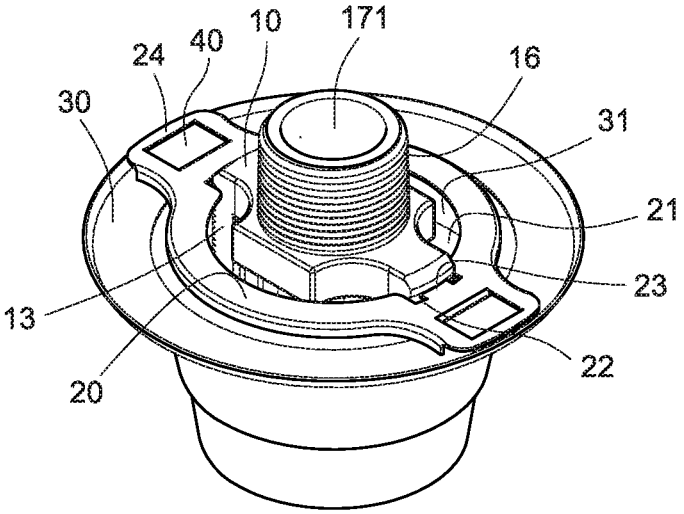
FIG. 1 is a three-dimensional explosive view of a first embodiment of a concealed fire sprinkling head having a decorating fastened structure of the present invention.
Figure 2:
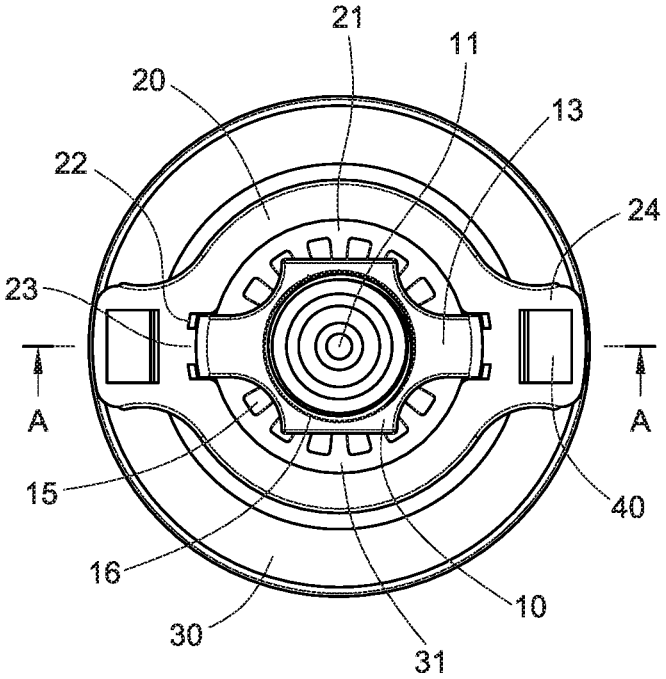
FIG. 2 is a top view showing the concealed fire sprinkling head of FIG. 1 of the present invention.
Figure 3:
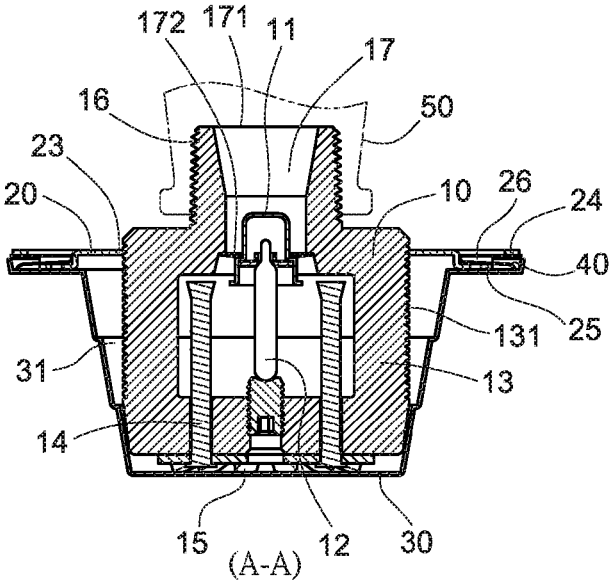
FIG. 3 is a cross-section view along a line A-A of FIG. 2.

Please refer to FIGS. 1 to 3 which respectively disclose a configuration of a first preferred embodiment of the present invention demonstrating a concealed fire sprinkling head having a decorating fastened structure provided in the present invention comprising a fastening piece 20 and a decorating cover 30.

The fastening piece 20 is mounted on a sprinkling head. In more details, the sprinkling head comprises a valve seat 10. A screw portion 16 is formed on a top end of the valve seat 10. The valve seat 10 can be mounted on a fire pipe 50 by the screw portion 16. A passage 17 is formed in the valve seat 10. At two ends of passage 17, a water inlet 171 and a valve hole 172 are respectively formed on a surface of the valve seat 10. The passage 17 is fluidly connected to the fire pipe 50 through water inlet 171 so that the water in the fire pipe 50 can be transferred from the passage 17 to the valve hole 172 via the water inlet 171 to drain out. In one embodiment, a water valve 11 is disposed at the valve hole 172. The water valve 11 can control a draining timing of the water in the fire pipe 50. A temperature sensing glass rod 12 is disposed at the bottom of the water valve 11. The temperature sensing glass rod 12 normally pushes upwardly to hold the water valve 11 to turn off the valve hole 172 to prevent the water in the fire pipe 50 from leakage to the outside.

Two ribs 13 are respectively formed at opposite axial sides of the passage 17 at two ends of the valve seat 10. The rib 13 is used for holding and positioning the temperature sensing glass rod 12 to maintain and to position in the valve seat 10. A guiding rod 14 which can move and slide in an axial direction of passage 17 is formed at a bottom side of the rib 13. A disk-shaped spoiler 15 which can form a water curtain from the water drained from the valve hole 172 by the spoiler 15 is fluidly connected to the guiding rod 14 in order to enhance a spraying area of the water.

Figure 5:
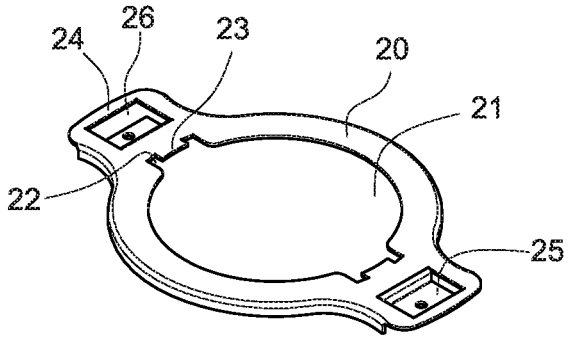
FIG. 5 is a three-dimensional explosive view of a fastening piece of FIG. 1 of the present invention.

Please refer to FIGS. 3 and 5 demonstrating in one embodiment the fastening piece 20 is a sheet-shaped body and the fastening piece 20 is fastened to the ribs 13 located at both sides of the valve seat 10. In one embodiment, a passing hole 21 for the sprinkling head to extend and to pass through the passing hole 21 is formed at a center of the fastening piece 20. A guiding groove 22 is respectively symmetrically formed at both inner sides of the passing hole 21. In more details, an inner diameter of the passing hole 21 is smaller than the outer diameter of the valve seat 10 to restrict a combining way between the valve seat 10 and the fastening piece 20 and to guide the fastening piece 20 to be fastened to the valve seat 10. Furthermore, a tongue strip-like clip hook 23 extends and is formed from an inner side of the guiding groove 22. A plurality of fastening slots 131 spaced apart each other are formed on the rib 13. In implementation, the fastening slot 131 is an outer tooth-shaped body. The clip hook 23 can be fastened in the fastening slot 131 so that the fastening piece 20 can regulate a level engaging position on the valve seat 10.

Please refer to FIGS. 1 and 3 demonstrating the decorating cover 30 is fixed to the bottom of the fastening piece 20. In more details, the decorating cover 30 is adhered and fixed to a bottom of the fastening piece 20 by using a low temperature melting metal (for example, tin) for adhering. When high temperature of a hot air of a fire causes the low temperature melting metal to melt down so as to drop the decorating cover 30 from the fastening piece 20, the hot air contacts with the temperature sensing glass rod 12 to be cracked down in order to open the water valve 11 to spray water. In implementation, an ear portion 24 respectively extends and is formed from both outer sides of the fastening piece 20. A leg 25 is formed at a bottom of the ear portion 24. The leg 25 is made by punching the ear portion 24. The leg 25 is bended downwardly and horizontally to exhibit an L-shaped body. The decorating cover 30 is adhered and fixed to a bottom of the leg 25 by using a low temperature melting metal.

In implementation the decorating cover 30 is a cup-shaped body. A cavity 31 is formed in the decorating cover 30. In one embodiment the cavity 31 extends in the axial direction of the passage 17. The clip hook 23 can be fastened in the fastening slot 131 to regulate a level engaging position on the valve seat 10 so that the valve seat 10, the temperature sensing glass rod 12, the guiding rod 14 and the spoiler 15 can be axially positioned to a desired level in the cavity 31 along the passage 17.

Figure 4:
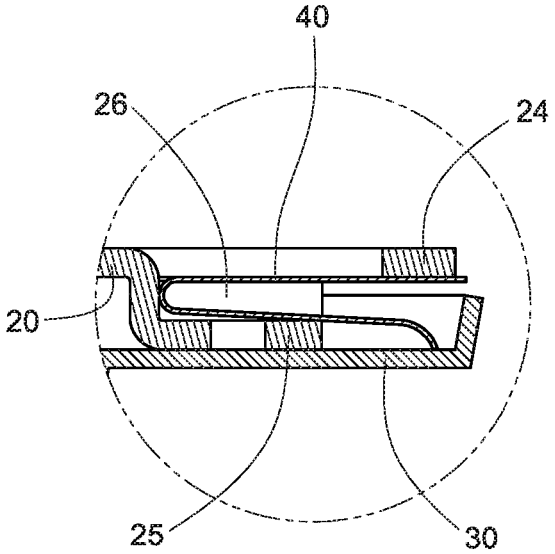
FIG. 4 is a partially enlarged view showing the concealed fire sprinkling head of FIG. 3 of the invention.

Please refer to FIGS. 3 and 4 which demonstrate that the elastic component 40 is disposed between the fastening piece 20 and the decorating cover 30. In one embodiment, the elastic component 40 is an L-shaped elastic sheet. In implementation, the two ends of the elastic component 40 respectively contact with the ear portion 24 and the decorating cover 30. In implementation, a receiving groove 26 having an opening extending outwardly is formed between the leg 25 and the ear portion 24. The elastic component 40 is disposed in the receiving groove 26 so that two ends of the elastic component 40 respectively contact with the ear portion 24 and the decorating cover 30. When hot air melts down the low temperature melting metal to decrease the adhering force of the decorating cover 30, the decorating cover 30 can fast drop from the bottom of the fastening piece 20 for facilitating turning on the water valve 11 to spray water.

Figure 6:
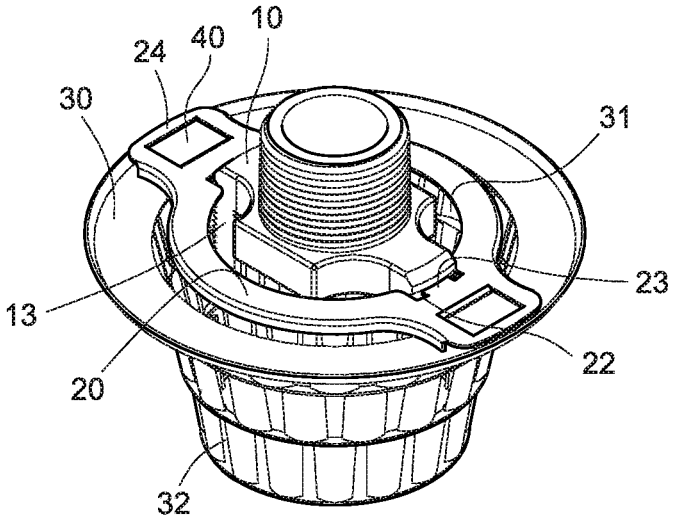
FIG. 6 is a three-dimensional explosive view of a second embodiment of a concealed fire sprinkling head of the present invention.

Please refer to FIG. 6 demonstrating a second embodiment of a concealed fire sprinkling head having a decorating fastened structure provided in the present invention. The differences between the second embodiment and the first embodiment of the present invention are a plurality of ventilating holes 32 which are formed on a surface of the decorating cover 30 by punching. Air flow can be guided by the ventilating holes 32 to fast contact with the temperature sensing glass rod 12 in the cavity 31 to increase the temperature of the temperature sensing glass rod 12. In implementation, the ventilating holes 32 can be designed using geometry shapes.

Although the present invention has been explained in relation to its preferred embodiment, it is to be understood that any other possible modifications and variations can be made without departing from the scope of the invention as hereinafter claimed.

I claim:

1. A concealed fire sprinkling head having a decorating fastened structure comprising:

a sprinkling head at both sides of which a rib is formed, and a fastening slot being respectively formed at an outer wall of the rib;

a sheet-like fastening piece at a center of which a passing hole for extending and passing through the sprinkling head, a guiding groove being symmetrically formed at an inner side of the passing hole, a clip hook being formed in the guiding groove, the rib being guided by the guiding groove for fastening in the fastening slot by the clip hook, and at least two tongue strip-like legs being formed at a periphery of the fastening piece; and a cup-like decorating cover adhered to a bottom of the fastening piece via the legs, a cavity being formed in the decorating cover for receiving the sprinkling head.

2. The concealed fire sprinkling head having the decorating fastened structure as claimed in claim 1, wherein a ventilating hole for fluidly connecting to the cavity is formed on a surface of the decorating cover.

3. The concealed fire sprinkling head having the decorating fastened structure as claimed in claim 1, wherein an ear portion extends and is formed at two ends of the fastening piece, and the legs are respectively formed at a bottom of the ear portion.

4. The concealed fire sprinkling head having the decorating fastened structure as claimed in claim 3, wherein a receiving groove is formed between the ear portions and the legs, an elastic component is disposed in the receiving groove and two ends of the elastic component respectively contact the ear portions and the decorating cover.

5. The concealed fire sprinkling head having the decorating fastened structure as claimed in claim 4, wherein the elastic component is a spring having a U-shape.

* * * * *